US005684447A

United States Patent [19]

Korczynski et al.

[11] Patent Number: 5,684,447

[45] Date of Patent: Nov. 4, 1997

[54] FAILSAFE BIMETALLIC REED HAVING BIMETAL WITH FUSIBLE LINK FOR A CIRCUIT PROTECTOR

[75] Inventors: Jacek Korczynski, Niles; Lawrence R. Happ, Mundelein, both of Ill.

[73] Assignee: Cooper Industries, Inc., Houston, Tex.

[21] Appl. No.: 588,927

[22] Filed: Jan. 19, 1996

[51] Int. Cl.[6] ..... H01H 37/00; H01H 85/00

[52] U.S. Cl. ..... 337/5; 337/3; 337/35; 337/142; 337/333

[58] Field of Search ..... 337/3–6, 142, 337/333, 365, 369, 371, 35; 361/103, 104

[56] References Cited

U.S. PATENT DOCUMENTS

| | | | |
|---|---|---|---|
| 1,130,485 | 3/1915 | Davis | 335/142 |
| 2,295,350 | 9/1942 | Lincks | 337/5 |
| 2,427,181 | 9/1947 | Baskerville et al. | 337/6 |
| 2,440,861 | 5/1948 | Lamb | 361/157 |
| 2,741,726 | 4/1956 | Branflick et al. | 361/99 |
| 3,076,076 | 1/1963 | Bridges | 337/148 |
| 3,112,383 | 11/1963 | Smith, Jr. | 337/6 |
| 3,508,184 | 4/1970 | Cameron et al. | 337/150 |
| 3,611,235 | 10/1971 | Rose | 337/35 |
| 3,675,081 | 7/1972 | Earing | 361/41 |
| 3,693,048 | 9/1972 | Doversberger et al. | 361/103 |
| 3,706,952 | 12/1972 | Alley | 337/348 |
| 3,750,059 | 7/1973 | Patel et al. | 335/142 |
| 3,796,978 | 3/1974 | Grunert et al. | 335/142 |
| 3,796,980 | 3/1974 | Ellswort | 337/6 |
| 3,828,289 | 8/1974 | Hickling | 337/5 |
| 3,958,197 | 5/1976 | Gryctko | 335/18 |
| 4,034,326 | 7/1977 | Hill et al. | 337/34 |
| 4,219,857 | 8/1980 | Haraldsson et al. | 361/42 |
| 4,369,420 | 1/1983 | Blewitt | 337/148 |
| 4,380,001 | 4/1983 | Kasamatsu | 337/4 |
| 4,460,886 | 7/1984 | Jarosz et al. | 337/148 |
| 4,484,243 | 11/1984 | Herbst et al. | 361/50 |
| 4,491,820 | 1/1985 | Jarosz | 337/159 |
| 4,528,538 | 7/1985 | Andersen | 337/43 |
| 4,581,674 | 4/1986 | Brzozowski | 361/104 |
| 4,858,054 | 8/1989 | Franklin | 361/57 |
| 4,866,560 | 9/1989 | Allina | 361/104 |
| 4,873,604 | 10/1989 | Goldberg et al. | 361/104 |
| 4,885,561 | 12/1989 | Veverka et al. | 337/190 |
| 4,907,119 | 3/1990 | Allina | 361/56 |
| 4,949,060 | 8/1990 | Mikulecky | 337/4 |
| 4,970,619 | 11/1990 | Veverka et al. | 361/15 |
| 5,148,345 | 9/1992 | Allina | 361/104 |
| 5,193,044 | 3/1993 | Czerwiec | 361/104 |
| 5,225,800 | 7/1993 | Pannenborg et al. | 335/35 |
| 5,237,302 | 8/1993 | Harris | 337/4 |
| 5,294,902 | 3/1994 | Pannenborg et al. | 335/4 |

*Primary Examiner*—Leo P. Picard
*Assistant Examiner*—Jayprakash N. Gandhi
*Attorney, Agent, or Firm*—Burns, Doane, Swecker & Mathis LLP

[57] ABSTRACT

A bimetallic reed for a circuit protecting device includes an integral fusible portion as a failsafe interrupting mechanism. The bimetallic reed includes a body of electrical conductive materials and having a first end mountable to a terminal and a second end forming an interruptible contact portion. The body is shaped to deform at a central portion of the body when the body is heated to a predetermined temperature. The body includes a plurality of apertures adjacent to the contact portion defining a plurality of electrical conductive pathways connecting the central portion and the contact portion, wherein the plurality of conductive pathways is fusibly responsive to a predetermine electrical load condition to form a fusible link.

21 Claims, 2 Drawing Sheets

FAILSAFE BIMETALLIC REED HAVING BIMETAL WITH FUSIBLE LINK FOR A CIRCUIT PROTECTOR

FIELD OF THE INVENTION

The present invention relates to a bimetallic reed for circuit protecting devices.

BACKGROUND AND SUMMARY

Electrical contacts for switchable devices such as circuit breakers are intended to repeatedly make and break electrical contact, and by doing, control the electrical load in the circuit. Repeated use causes wear in the contact parts due to arcing erosion, which over time may lead to a breakdown of the contacts. Eventually, the contacts may weld together, resulting in a failure of the switching device. In the case of a circuit breaker, weld failures create a safety hazard by disabling the circuit interrupt function, leaving the circuit vulnerable to electrical overloads.

In thermal circuit breaker devices, a bimetallic reed which deforms when heated by an electrical current, is used to make and break the contact. Bimetallic reeds are typically formed with a curvature so that when cold, the contact end of the reed is biased against a contact terminal of the circuit breaker, thus completing the circuit. When the reed is heated by an electrical overload condition, deformation of the reed causes the reed to snap at the curved portion, which moves the contact end away from the contact terminal. A weld failure in a bimetallic reed prevents the snap action from moving the contact end away from the contact terminal, and thus, causes a failure of the interrupt function.

The present invention provides a bimetallic reed with an integral fusible link that performs as a circuit breaker in low electrical overload conditions, and acts as a fusible device under high overload conditions. A bimetallic reed according to the invention will act as a fusible device in the event of a weld failure of the reed contact and terminal contact, thus overcoming deficiencies in the art.

The bimetallic reed according to the invention is well suited for direct current circuit protection, for example, in automotive electrical systems.

A bimetallic reed with an integral fusible link according to the invention includes a plurality of apertures formed in the reed to define a plurality of narrowed electrical conducting paths, which forms a fusible link between the body of the bimetallic reed and the contact of the reed. In the event of an average overload condition, the snap action of the bimetallic reed will break the electrical pathway. If a more serious contact weld failure occurs, preventing the normal "snap action", the fusible link will melt, breaking the electrical pathway and allowing the device to "fail safe".

According to another aspect of the invention, the bimetallic reed incorporates the fusible link at a portion of the reed that does not bend during snap action in thermal overload, which improves the reliability of the reed. A fusible link located at the bending portion of the bimetallic reed could result in unwanted mechanical failure of the fusible link by the repeated bending of the reed, causing the device to fail, and the circuit to open, prematurely.

According to another aspect of the invention, the plurality of apertures are uniformly spaced so that identically sized electrical pathways are formed in the reed. This feature of the invention improves the reliability of the fusing function by equal distribution of the electrical load on all of the pathways.

According to yet another feature of the invention, the apertures are arranged in a semicircular path surrounding the contact, which permits placement of the apertures at a uniform distance from the contact.

BRIEF DESCRIPTION OF THE DRAWINGS:

The invention will be better understood by the following description in conjunction with the appended drawings, wherein like elements are provided with the same reference character. In the drawings.

DETAILED DESCRIPTION

Figure 1:
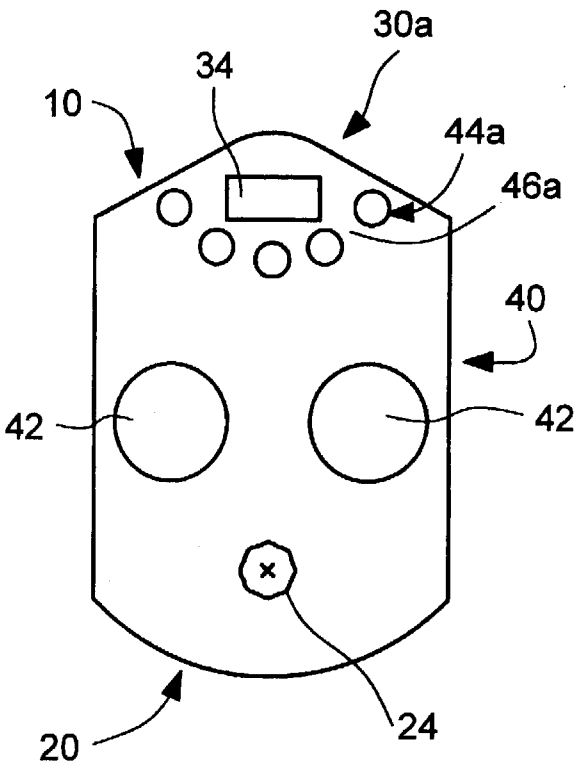
FIG. 1 is a plan view of a bimetallic reed according to the invention.
Figure 2:
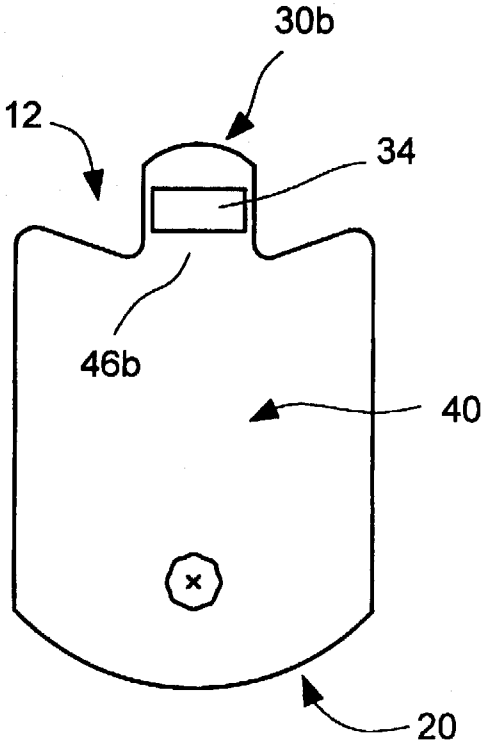
FIG. 2 is a plan view of an alternative embodiment of the reed of FIG. 1.
Figure 3:
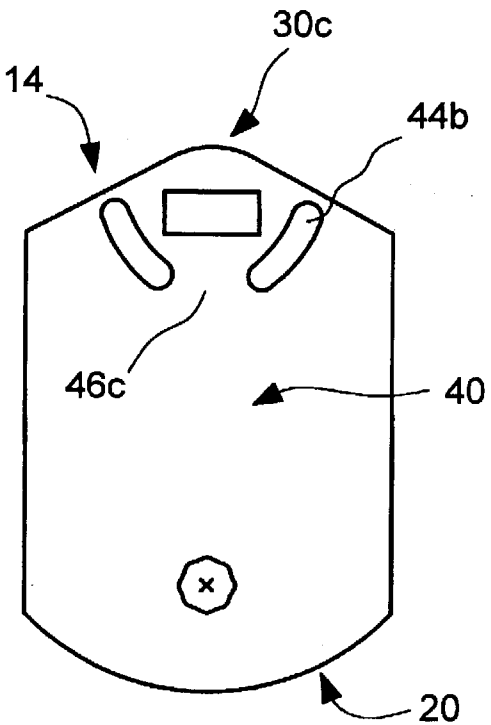
FIG. 3 is a plan view of another alternative embodiment of the reed of FIG. 1.
Figure 4:
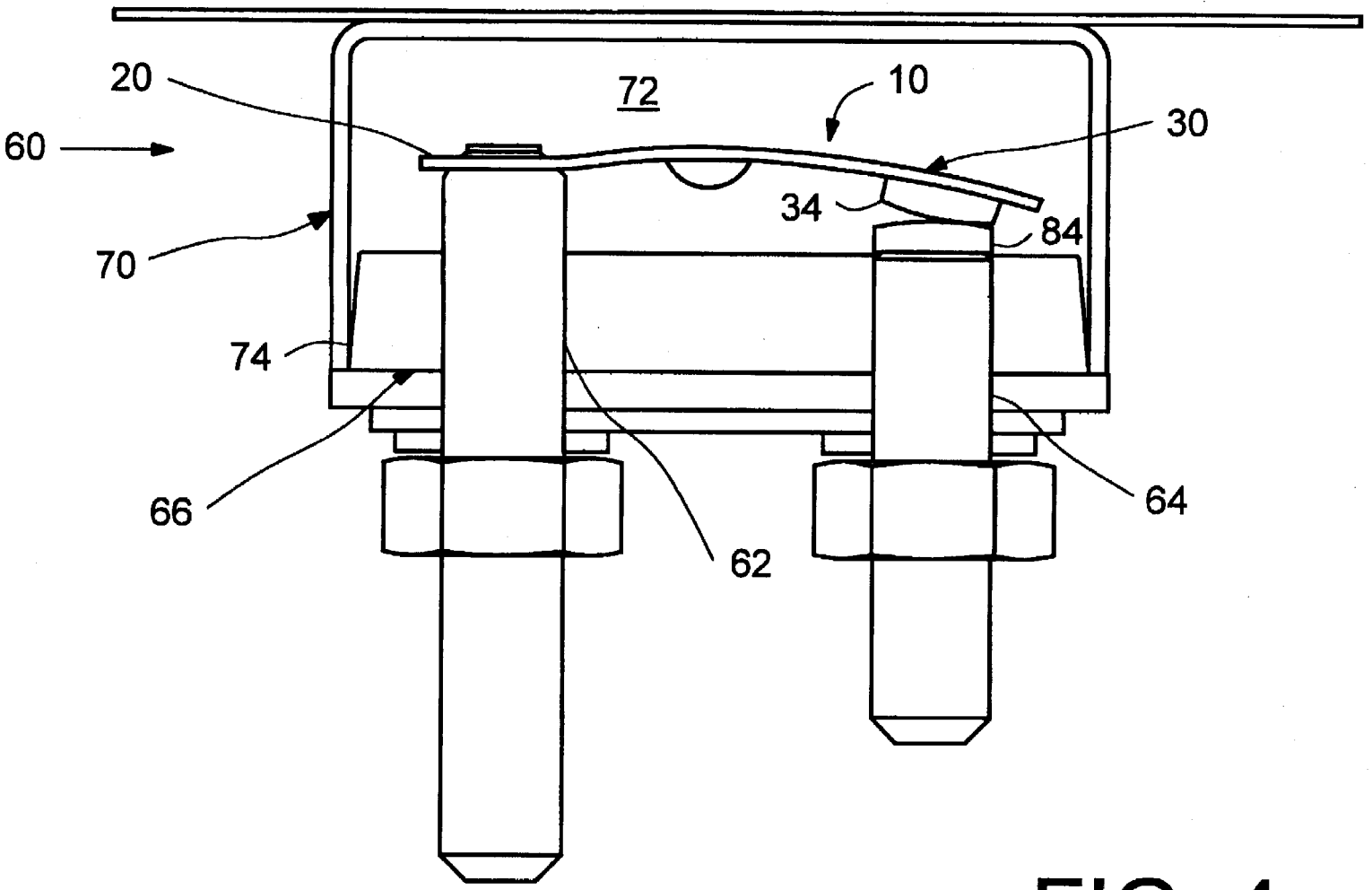
FIG. 4 is a sectional view of a circuit protecting device incorporating a bimetallic reed according to the invention.

FIGS. 1–3 illustrate bimetallic reeds according to the invention. FIG. 4 illustrates the reed according to the invention mounted in a circuit protecting device 60. The circuit protector 60 is intended to be illustrative only; the reed according to the invention may be incorporated in other devices and is not limited to the device shown. The illustrative circuit protector 60 includes two studs 62, 64 mounted in a base 66 so that the studs extend from opposite face of the base. A cover 70 encloses an upper face of the base 66 to define an interior space 72. The cover 70 may be fastened to the base by an ultrasonic weld joint 74, or other suitable means.

Referring to FIG. 1 and FIG. 4, a reed 10 according to the invention comprises a thin bimetallic body formed in any suitable manner, with the metals making up the bimetallic reed being chosen to have a predetermined response. The reed 10 has a first end portion 20 and a second end portion 30. The first end portion 20 includes a mounting hole 24 for fixedly attaching the reed 10 to a mounting stud 62 in the circuit protecting device 60.

The second end portion 30 includes an element 34 of electrically conductive material. The second end portion 30 serves as a movable contact portion relative to a fixed contact 84 in the circuit protecting device 60. Contact 84 is mounted on stud 64. As may be seen in FIG. 4, which shows a side view of the reed 10, the reed body is shaped with a curvature extending from the first end portion 20 to the second end portion 30. The curvature is concave in the direction of the mounting stud 62 and the fixed contact 84 and is most pronounced in the central portion 40 of the reed 10. The curvature biases the contact portion of the reed against the fixed contact 84 to ensure good electrical contact under normal conditions. The bimetallic reed is formed with metals having dissimilar temperature expansion characteristics so that at a predetermined limit temperature resulting from an electrical overload condition, the reed snaps out of the curved shape shown, and contact between the contact element 34 and the fixed contact 84 is broken. The central portion 40 includes a pair of dome shaped depressions 42, laterally adjacent and formed in the direction of the curvature. The depressions 42 facilitate automatically returning the reed 10 to the shape shown in FIG. 4 when the overload condition is corrected and the reed temperature drops below the predetermined limit temperature. Thus, the reed 10 may be automatically resettable.

Under repeated making and breaking of the contact element 34 and the fixed contact 84, the contact elements deteriorate. Eventually, the contact element 34 and the contact 84 may weld together during electrical overload, which prevents the snap action of the reed 10 from breaking contact. The circuit protecting function is thus defeated, and damage to the circuit may result.

The reed according to the invention provides a solution to this problem by including an integral fusible portion as part of the reed body 10. As shown in FIG. 1, the body includes a plurality of apertures 44*a* adjacent to the contact portion 20. According to a preferred embodiment of the invention, the apertures 44*a* are formed as four or five circular holes. Five holes are in the reed 10 shown in FIG. 1, and are uniform spaced from each other. The apertures 44*a* define a plurality of substantially uniformly sized electrical pathways 46*a* connecting the central portion 40 and the contact portion 30*a* of the reed 10. The plurality of electrical pathways 46*a* presents a reduced cross sectional area for current flow between the central portion 40 and the contact portion 30*a*. In the event of electrical overload when the contacts 34 and 84 are welded together and the reed is unable to snap to break the contact, the electrical pathways 46*a* will be heated beyond capacity, and will fuse, thus breaking electrical contact between the studs 62 and 64, and protecting the circuit. The magnitude of the cross sectional area of the electrical pathways 46 may be selected for a particular fusible response, and may be varied by selection of the diameter of the holes. Four or five holes, and the resulting plurality of electrical pathways has been found to be most advantageous in producing the desired function of the fusible portion.

The inventors have discovered that locating the apertures 44*a* and fusible pathways 46*a* adjacent to the movable contact portion 30*a* improves the functional life of the reed and provides a more reliable fusing function. The movable contact portion 30 experiences little deformation during the snap action of normal operation of the reed 10. By contrast, the fixed end portion 20 experiences greater deformation and stresses, related at least in part to the force exerted by the mounting fastener during snap action. The central portion 40, of course, undergoes a reversal of the curvature. If the apertures were located in either of the fixed end portion 20 or the central portion 40, the pathways 46*a* may fail prematurely from the mechanical bending in repeated snap action.

FIGS. 2 and 3 illustrate alternative embodiments of the reed, differing from FIG. 1 in the configuration of the fusible pathway. In FIG. 2, a reed 12 has a fusible pathway 46*a* formed as a single reduced cross sectional portion connecting the central portion 40 and the movable contact portion 30*b* by the removal of material on opposing lateral sides at the contact portion 30*b*.

FIG. 3 illustrates a reed 14 having apertures formed as two elongated slots 44*c* surrounding the contact portion 30*c*. The slots define a plurality of reduced cross sectional conductive areas between the central portion 40 and the contact portion 30*c*.

The foregoing has described the preferred principles, embodiments and modes of operation of the present invention; however, the invention should not be construed as limited to the particular embodiments described. Instead, the above-described embodiments should be regarded as illustrative rather than restrictive, and it should be appreciated that variations, changes, and equivalents may be made by others without departing from the scope of the present invention as defined by the following claims.

What is claimed is:

1. A bimetallic reed for a circuit protecting device, comprising a body of electrical conductive materials and having a first end mountable to a terminal and a second end forming an interruptible contact portion, the body having a normal shape deformable at least at a central portion of the body when the body is heated to a predetermined temperature, the body including a fusible link of reduced cross sectional area connecting the central portion and the contact portion, said fusible link being fusibly responsive to a predetermined electrical load condition.

2. The bimetallic reed as claimed in claim 1, wherein said fusible portion is formed by a plurality of apertures adjacent to the contact portion defining a plurality of electrical conductive pathways.

3. The bimetallic reed as claimed in claim 2, wherein the plurality of apertures is arranged in an arc around the contact portion, each aperture being substantially a uniform distance from a predetermined point at the contact portion.

4. The bimetallic reed as claimed in claim 3, wherein the apertures are positioned in the arc to have a uniform space between adjacent apertures.

5. The bimetallic reed as claimed in claim 2, wherein the apertures are formed as circular holes.

6. The bimetallic reed as claimed in claim 2, wherein the apertures are formed as rectangular holes.

7. The bimetallic reed as claimed in claim 2, wherein at least three apertures are formed in the reed body.

8. The bimetallic reed as claimed in claim 2, wherein five apertures are formed in the reed body.

9. The bimetallic reed as claimed in claim 1, wherein the body is shaped to have a curvature between the first end and the second end at least in the central portion.

10. The bimetallic reed as claimed in claim 9, wherein the central portion is shaped to have two dimpled depressions, positioned laterally adjacent and protruding toward a concave side of the body.

11. The bimetallic reed as claimed in claim 10, wherein the bimetallic reed is automatically resettable.

12. A circuit protecting device, comprising:

a base having a top side and a bottom side;

a first terminal stud mounted in the base and extending from the top side and the bottom side;

a second terminal stud mourned in the base and extending from the top side and the bottom side and spaced from the first terminal stud;

a bimetallic reed having a first end portion and a second end portion, the bimetallic reed being deformable in a central portion responsive to a predetermined temperature, and being disposed on the first side of the base, the first end portion being fixed to the first terminal stud, the bimetallic reed having a normal position in which the second end portion is in contact with the second terminal stud, and having a plurality of apertures adjacent to the second end portion forming a fusible link; and, a cover defining an enclosure with the first side of the base to enclose the bimetallic reed.

13. The circuit protecting device as claimed in claim 12, wherein the plurality of apertures is arranged in an arc around the contact portion, each aperture being substantially a uniform distance from a predetermined point at the contact portion.

14. The circuit protecting device as claimed in claim 13, wherein the apertures are positioned in the arc to have a uniform space between adjacent apertures.

15. The circuit protecting device as claimed in claim 12, wherein the apertures are formed as circular holes.

16. The circuit protecting device as claimed in claim 12, wherein the apertures are formed as rectangular holes.

17. The circuit protecting device as claimed in claim 12, wherein at least three apertures are formed in the reed body.

18. The circuit protecting device as claimed in claim 12, wherein five apertures are formed in the reed body.

19. The circuit protecting device as claimed in claim 12, wherein the body is shaped to have a curvature between the first end and the second end at least in the central portion.

20. The circuit protecting device as claimed in claim 19, wherein the central portion is shaped to have two dimpled depressions, positioned laterally adjacent and protruding toward a concave side of the body.

21. The circuit protecting device as claimed in claim 20, wherein the bimetallic reed is automatically resettable.

* * * * *